US006600405B1

(12) United States Patent
Kremers et al.

(10) Patent No.: US 6,600,405 B1
(45) Date of Patent: Jul. 29, 2003

(54) SELF-REGENERATING CURRENT LIMTER WITH LIQUID METAL

(75) Inventors: Wolfgang Kremers, Bonn (DE); Frank Berger, Swistal-Miel (DE); Andreas Kraetzschmar, Bonn (DE)

(73) Assignee: Moeller GmbH, Bonn (DE)

( * ) Notice: Subject to any disclaimer, the term of this patent is extended or adjusted under 35 U.S.C. 154(b) by 0 days.

(21) Appl. No.: 09/958,544

(22) PCT Filed: Mar. 30, 2000

(86) PCT No.: PCT/EP00/02777

§ 371 (c)(1),
(2), (4) Date: Jan. 23, 2002

(87) PCT Pub. No.: WO00/62321

PCT Pub. Date: Oct. 19, 2000

(30) Foreign Application Priority Data

Apr. 12, 1999 (DE) ..... 199 16 324

(51) Int. Cl.[7] ..... H01H 87/00; H01H 29/02

(52) U.S. Cl. ..... 337/21; 337/122; 337/167; 337/121; 337/119; 335/57; 335/50; 335/49; 335/51; 439/181

(58) Field of Search ..... 337/167, 21, 114, 337/119, 121, 122; 335/47, 49, 50, 51, 57; 200/32, 81.6, 152; 361/58; 439/88, 181; 29/622

(56) References Cited

U.S. PATENT DOCUMENTS

| | | | | | |
|---|---|---|---|---|---|
| 1,595,061 | A | * | 8/1926 | Valerius | 337/119 |
| 3,249,722 | A | * | 5/1966 | Lindberg, Jr. | 337/21 |
| 3,331,937 | A | * | 7/1967 | Harvey | 200/209 |
| 3,381,248 | A | * | 4/1968 | Furth | 335/51 |
| 3,389,359 | A | * | 6/1968 | Harris | 337/114 |
| 3,389,360 | A | * | 6/1968 | Keenan | 337/114 |
| 3,670,282 | A | | 6/1972 | Itoh et al. | 337/21 |
| 3,699,489 | A | * | 10/1972 | Imajyo | 337/21 |
| 3,838,373 | A | * | 9/1974 | Inoue et al. | 337/21 |
| 4,429,295 | A | * | 1/1984 | Wu | 337/119 |
| 4,510,356 | A | * | 4/1985 | Malm | 200/48 R |
| 4,747,783 | A | * | 5/1988 | Bellamy et al. | 439/59 |
| 4,925,394 | A | * | 5/1990 | Hayashi et al. | 439/86 |
| 5,471,185 | A | * | 11/1995 | Shea et al. | 335/51 |
| 5,581,192 | A | * | 12/1996 | Shea et al. | 324/722 |
| 6,007,390 | A | * | 12/1999 | Cheng et al. | 439/886 |

FOREIGN PATENT DOCUMENTS

| | | | | |
|---|---|---|---|---|
| DE | 2028593 | | 8/1973 | |
| DE | 2652506 | | 5/1978 | |
| DE | 3132087 | A1 * | 8/1982 | H01H/29/00 |
| DE | 4012385 | | 3/1991 | |
| GB | 927395 | | 5/1963 | |
| GB | 2036443 | A * | 6/1980 | H01H/1/06 |
| SU | 922911 | | 4/1982 | |
| SU | 1076981 | | 2/1984 | |
| SU | 1094088 | | 5/1984 | |

* cited by examiner

*Primary Examiner*—Anatoly Vortman
(74) *Attorney, Agent, or Firm*—Davidson, Davidson & Kappel, LLC

(57) ABSTRACT

A self-regenerating current limiter with liquid metal includes solid metal electrodes for connection of the current limiter to an electric circuit to be protected. A plurality of compression chambers that are partially filled with liquid metal are located one behind the other between the electrodes. The compression chambers are formed by compression-proof insulating bodies and insulating partition walls that have communicating channels and that are supported by the insulating bodies. Non-conductive ceramic disks are mounted on the inner surfaces of the electrodes. The disks are located opposite the communicating channels of the adjacent partition walls.

12 Claims, 1 Drawing Sheet

SELF-REGENERATING CURRENT LIMTER WITH LIQUID METAL

BACKGROUND

The present invention relates to a self-recovering current-limiting device with liquid metal, including electrodes made of solid metal for the connection to an electric circuit to be protected and a plurality of compression spaces which are partially filled with liquid metal.

Soviet Union Patent Publication SU 922 911 A describes a self-recovering current-limiting device containing electrodes made of solid metal which are separated by first insulating bodies which are designed as a pressure-resistant insulating housing. Inside the insulating housing, compression spaces are formed by insulating intermediate walls and second insulating bodies which are arranged therebetween and designed as ring-shaped sealing disks, the compression spaces being partially filled with liquid metal and arranged one behind the other and interconnected via connecting channels of the intermediate walls, the connecting channels being filled with liquid metal and arranged off-center. Thus, in normal operation, a continuous, inner conductive connection exists between the electrodes via the liquid metal. In the current-limiting event, the liquid metal is displaced from the connecting channels as a result of the high current density. In this manner, the electrical connection of the electrodes via the liquid metal is interrupted, resulting in the limiting of the short-circuit current. Subsequent to clearing or eliminating the short circuit, the connecting channels refill with liquid metal whereupon the current-limiting device is operational again. In German Patent Application DE 40 12 385 A1 , a current-limiting device having only one compression space is described and vacuum, protective gas, or an insulating liquid are mentioned as the medium above the liquid level. According to Soviet Union Patent Publication SU 1 076 981 A, the connecting channels of adjacent intermediate walls are staggered relative to each other for improving the limiting characteristics. In Soviet Union Patent Publication SU 1 094 088 A, copper is specified as a highly conductive material for the electrodes. It is known from German Patent Application DE 26 52 506 A1 to use gallium alloys, in particular GaInSn alloys in contact devices.

During current-limiting events, the inner electrode surfaces come into contact with the developing electric arcs, which in first place gives rise to arc erosion phenomena in the parts of the electrode surfaces that are located opposite of the connecting channels and, secondly, to the contamination of the liquid metal and ultimately, therefore, to an unsatisfactory service life of the current-limiting device. Besides, the current-limiting behavior still deserves improvement.

SUMMARY OF THE INVENTION

Therefore, an object of the present invention is to provide a current-limiting device having improved service life and current-limiting behavior.

The present invention provides a self-recovering current-limiting device. The device includes a first and a second electrode for connection to an electric circuit to be protected, each of the first and second electrodes being made of a respective solid metal. A respective non-conductive ceramic disk is disposed at a respective inner surface of each of the first and second electrodes. A plurality of pressure-resistant insulating bodies is provided, and a plurality of insulating intermediate walls are supported by the plurality of insulating bodies. The plurality of insulating intermediate walls and the plurality of pressure-resistant insulating bodies define a plurality of compression spaces, the plurality of compression spaces being disposed one behind the other between the first and second electrodes and being at least partially filled with a liquid metal. The plurality of insulating intermediate walls define a plurality of connecting channels therein, each of the respective non-conductive ceramic disks being disposed opposite of the respective connecting channel of a respective adjacent one of the plurality of insulating intermediate walls.

Because of the non-conductive ceramic disks which locally protect the electrodes, an electric arc developing during external short circuits no longer burns on the electrodes but substantially only in the liquid metal due to the relatively large distance from the conductive regions of the inner surfaces of the electrodes. In this manner, arc erosion of the electrode material is considerably reduced, thus attaining a longer service life even after a relative large number of short circuits. Moreover, the arc voltage of the electric arc is raised due to the enlarged distance of a connecting channel from the reachable conductive surface of an electrode. This brings about an improved current-limiting behavior of the current-limiting device and results, moreover, in a lower loading of the current-limiting device and of the electric circuit to be protected. During nominal operation, the current in the liquid metal is forced by the non-conductive ceramic disks to flow around them. In this manner, the current distribution in the electrodes is homogenized to a considerable degree as a result of which locally heated regions in the electrodes are obviated which, in turn, has a beneficial effect on the material stability thereof.

Advantageous are ceramic disks on the basis of boron nitride, silicon carbide, silicon nitride or aluminum oxide, it being possible for the ceramic disks to be adhesively bonded or soldered to the inner surfaces in an expedient manner, or to be inserted in a suitable way.

A further refinement of the present invention consists in providing the inner surfaces of the electrodes with a conductive material layer which is diffusion-resistant with respect to the liquid metal. In this manner, in addition, the diffusion and corrosion of the inner electrode surfaces which are wetted by the liquid metal is effectively coped with, resulting in a considerable increase of the surface resistivity of the electrodes and, consequently, of the stability and service life of the current-limiting device. Expediently, the material layer is composed of one of the proposed transitional metals or alloys thereof, it being possible for the material layer to be advantageously designed as a small plate which is mounted on the inner surfaces of the electrodes, for example, by adhesive bonding or soldering, or which is inserted flush with the inner surfaces of the electrodes, or as a metal layer which is applied to the inner surfaces of the electrodes by electroplating, vapor deposition or friction welding. Underneath a non-conductive ceramic disk, the material layer can either be completely or partially continued or also be cut out.

It is advantageous to use a gallium alloy as the liquid metal. Especially GaInSn alloys are easy to handle because of their physiological harmlessness. An alloy of 660 parts by weight of gallium, 205 parts by weight of indium, and 135 parts by weight of tin is liquid from 10° C. to 2000° C. at normal pressure and possesses sufficient electrical conductivity.

BRIEF DESCRIPTION OF THE DRAWING

Further details of the present invention will be explained based on an exemplary embodiment described in the following with reference to the drawing, in which.

DETAILED DESCRIPTION

Figure 1:
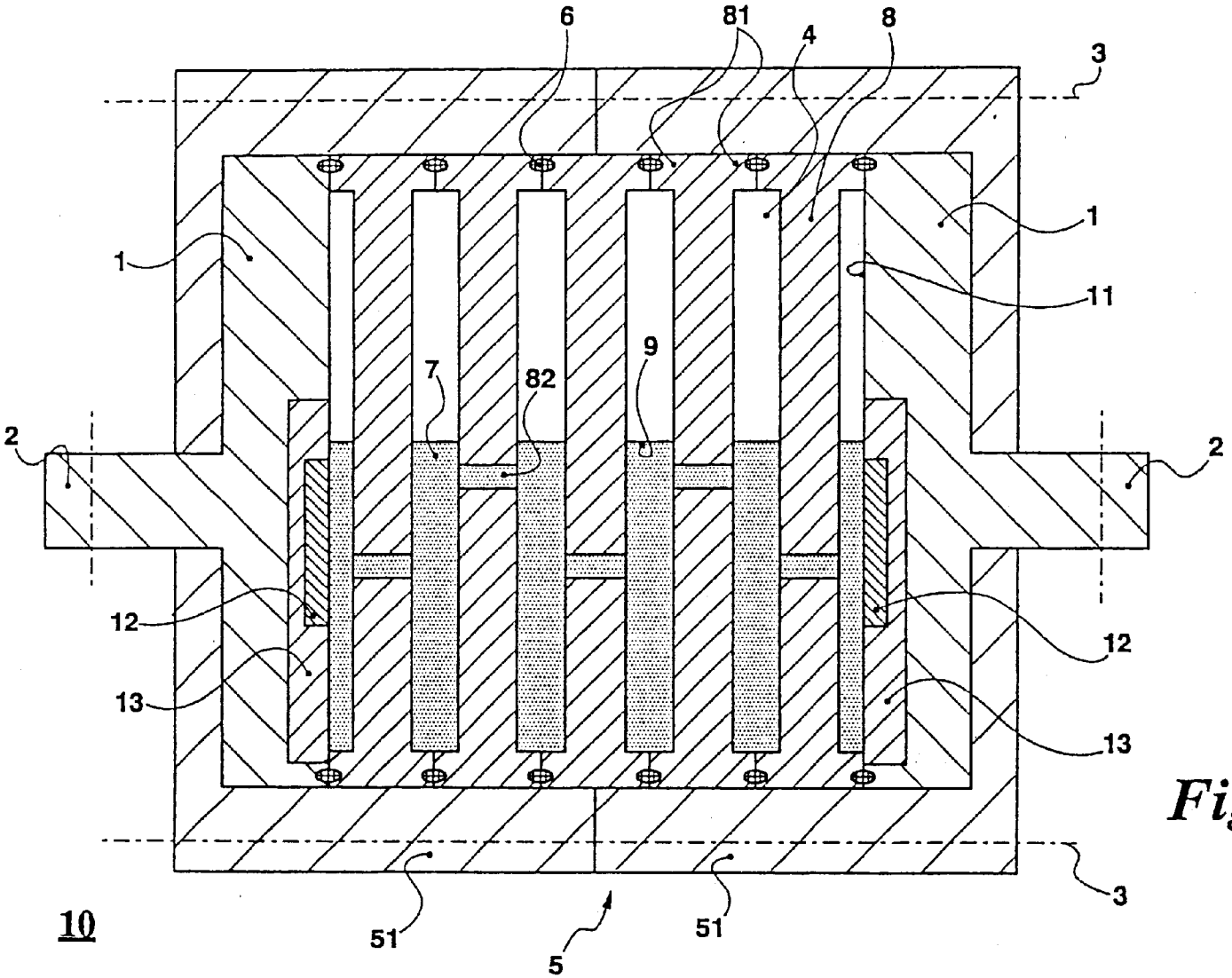
FIG. 1 shows a current-limiting device in a longitudinal cross-section.

Current-limiting device 10 according to FIG. 1 contains one electrode 1 made of solid metal, preferably of copper, on each of the two sides, the electrode merging into an outer connecting conductor 2. Located between electrodes 1 are a plurality of compression spaces 4 which are formed by a corresponding number of insulating intermediate walls 8 featuring annularly shaped collars 81 on both sides of the edges. The two outer compression spaces 4 are each laterally bounded by one of electrodes 1 and by an intermediate wall 8. Inner compression spaces 4 are each laterally bounded by two intermediate walls 8. Intermediate walls 8 are composed of a temperature and arc-resistant material. Electrodes 1 and intermediate walls 8 are supported in a force-locking manner by an insulating body in the form of a molded hosing 5 which is composed of two identical shell-shaped housing parts 51. For frictionally connecting the two housing parts 51, known means, for example, continuous clamping bolts along the two lines 3, are provided which, however, are not shown for reasons of clarity. Used for sealing compression spaces 4 are sealing rings 6 which are inserted into opposing grooves on the faces of collars 81 and of electrodes 1, respectively. Housing halves 51 are pressure-resistant insulating bodies. All compression spaces 4 are partially filled with a liquid metal 7, for example, a GalnSn alloy. Below liquid level 9, intermediate walls 8 are provided with connecting channels 82. During nominal operation, connecting channels 82 are also filled with liquid metal 7, so that a continuous electrically conductive connection exists between electrodes 1. Connecting channels 82 of adjacent intermediate walls 8 are advantageously staggered relative to each other to impede a continuous electric arc in the current-limiting event. Located above liquid metal 7 is, for example, vacuum; however, a protective gas would also be possible.

Inserted in surface 11 of each electrode 1 which surface faces toward the interior of current-limiting device 10, is a plate-like conductive material layer 13 which, in this manner, forms a part of inner surface 11 of respective electrode 1 which inner surface 11 is partially wetted by liquid metal 7. Material layers 13 are inserted flush into an even, flat recess of electrodes 1 intended for this, for example, using hard-soldering, or brazing. In the example, material layers 13 are made of a high-alloy chromium nickel steel whereby the inner surfaces of electrodes 1 are conferred a high diffusion and corrosion resistance with respect to liquid metal 7. In material layers 13 themselves, non-conductive ceramic disks 12, for example of boron nitride, are adhesively bonded in place opposite of connecting channels 82 of outer intermediate walls 8, that is of the intermediate walls adjacent to electrodes 1. In a short-circuit event, the developing electric arc can no longer reach material layers 13 of electrodes 1 via a short path because of ceramic disks 12 but is unavoidably lengthened. Because of this, the arc erosion of inner surfaces 11, in particular of material layers 13, as a result of the electric arc is considerably reduced. Due to the combined provision of electrodes 1 with non-conductive ceramic layers 12 and conductive material layers 13, the service life of current-limiting device 10 is increased by a considerable degree. In addition, the current-limiting behavior of current-limiting device 10 is improved by the lengthening of the electric arc.

What is claimed is:

1. A self-recovering current-limiting device, the device comprising:

a first and a second electrode for connection to an electric circuit to be protected, each of the first and second electrodes being made of a respective solid metal;

a respective non-conductive ceramic disk disposed at a respective inner surface of each of the first and second electrodes;

a plurality of pressure-resistant insulating bodies; and a plurality of insulating intermediate walls supported by the plurality of insulating bodies;

wherein the plurality of insulating intermediate walls and the plurality of pressure-resistant insulating bodies define a plurality of compression spaces, the plurality of compression spaces being disposed one behind the other between the first and second electrodes and being at least partially filled with a liquid metal; and wherein the plurality of insulating intermediate walls define a plurality of connecting channels therein, each of the respective non-conductive ceramic disks being disposed opposite of the respective connecting channel of a respective adjacent one of the plurality of insulating intermediate walls.

2. The current-limiting device as recited in claim 1 wherein each of the respective ceramic disks respectively include at least one of boron nitride, silicon carbide, silicon nitride and aluminum oxide.

3. The current-limiting device as recited in claim 1 wherein each of the respective ceramic disks are adhesively bonded to the respective inner surface.

4. The current-limiting device as recited in claim 1 wherein each of the respective ceramic disks are soldered to the respective inner surface.

5. The current-limiting device as recited in claim 1 wherein each of the respective ceramic disks is at least partially received in the respective inner surface.

6. The current-limiting device as recited in claim 1 wherein at least a respective part of each of the respective inner surface wetted by the liquid metal includes a respective conductive material layer, each respective conductive material layer having a higher respective resistance than the liquid metal.

7. The current-limiting device as recited in claim 6 wherein each of the respective conductive material layer includes at least one of tungsten, molybdenum, vanadium, nickel, tantalum, titanium, rhenium, chromium, a tungsten alloy, a molybdenum alloy, a vanadium alloy, a nickel alloy, a tantalum alloy, a titanium alloy, a rhenium alloy, and a chromium alloy.

8. The current-limiting device as recited in claim 6 wherein each of the respective conductive material layer includes a respective high-alloy stainless steel.

9. The current-limiting device as recited in claim 6 wherein each respective conductive material layer includes a respective plate disposed on a respective portion of the respective electrode.

10. The current-limiting device as recited in claim 6 wherein each respective conductive material layer includes a respective plate at least partially received in a respective portion of the respective electrode.

11. The current-limiting device as recited in claim 6 each respective conductive material layer includes a respective metal layer disposed on a respective portion of the respective electrode by at least one of electroplating, vapor deposition and friction welding.

12. The current-limiting device as recited in claim 1 wherein the liquid metal includes a GaInSn alloy.

* * * * *